US005544455A

United States Patent [19]

DeBlock

[11] Patent Number: 5,544,455

[45] Date of Patent: Aug. 13, 1996

[54] SKYLIGHT WITH MODULAR SHAFT

[75] Inventor: David A. DeBlock, Holland, Mich.

[73] Assignee: ODL, Incorporated, Zeeland, Mich.

[21] Appl. No.: 289,405

[22] Filed: Aug. 12, 1994

[51] Int. Cl.[6] ..... E04B 7/18

[52] U.S. Cl. ..... 52/200; 52/204.56; 52/217; 52/220.8

[58] Field of Search ..... 52/200, 220.8, 52/217, 204.56

[56] References Cited

U.S. PATENT DOCUMENTS

| | | | |
|---|---|---|---|
| Re. 32,539 | 11/1987 | Jentoft et al. . | |
| Re. 32,915 | 5/1989 | Jentoft et al. . | |
| 2,875,710 | 3/1959 | Bechtold | 52/200 X |
| 4,339,900 | 7/1982 | Freeman . | |
| 4,389,823 | 6/1983 | Player | 52/200 |
| 4,409,767 | 10/1983 | Jentoft et al. . | |
| 4,449,340 | 5/1984 | Jentoft et al. . | |
| 4,549,379 | 10/1985 | Hoy et al. . | |
| 4,570,394 | 2/1986 | Jentoft et al. . | |
| 4,679,366 | 7/1987 | Hitchins | 52/217 |
| 4,733,505 | 3/1988 | Van Dame | 52/200 X |
| 4,750,302 | 6/1988 | Bechtold . | |
| 4,757,655 | 7/1918 | Jentoft et al. | 52/200 |
| 4,776,141 | 10/1988 | Powell | 52/200 |
| 4,787,184 | 11/1988 | Boidron | 52/217 |
| 4,809,468 | 3/1989 | Bareiss . | |
| 4,862,657 | 9/1989 | Jentoft et al. . | |
| 4,916,872 | 4/1990 | Young . | |
| 4,972,638 | 11/1990 | Minter | 52/200 |
| 5,099,622 | 3/1992 | Sutton . | |

OTHER PUBLICATIONS

Brochure entitled "Velux Roof Windows—More than a window . . . " date 1992.

*Primary Examiner*—Carl D. Friedman
*Assistant Examiner*—Christopher Todd Kent
*Attorney, Agent, or Firm*—Warner Norcross & Judd

[57] ABSTRACT

A skylight with a modular shaft. The skylight includes a curb surrounding an opening formed in a roof. The curb defines a downwardly opening channel with at least one serrated wall to receive the modular shaft. The modular shaft extends from the curb to an opening formed in a ceiling and includes a number of panels secured to one another by a number of corner connections. A hook with at least one serrated wall is mounted to each of the panels. The hooks fit into the channel such that the serrated walls contact one another and secure the shaft to the curb by a ratcheting effect.

15 Claims, 4 Drawing Sheets

SKYLIGHT WITH MODULAR SHAFT

BACKGROUND OF THE INVENTION

The present invention relates to skylights, and more particularly to a skylight having a modular shaft.

Skylights have long been used to allow natural light to enter a building through an opening formed in the roof. Skylights are available in variety of designs and shapes to fit almost any residential or commercial structure.

Typically, a skylight is installed by mounting a curb around an opening formed in the roof. The curb mounts directly to the roof in a weather-tight fashion to receive a glass panel assembly. A second opening is formed in the ceiling immediately below the opening formed in the roof, and a shaft is constructed between the two openings to hide the joists, rafters, and other roof members from sight. The shaft is typically constructed by framing and sheetrocking sidewalls between the two openings. This process requires skilled labor and is costly in terms of both time and materials.

A second technique for installing a skylight includes the use of a prefabricated shaft, such as the light well disclosed in U.S. Pat. No. 4,916,872 to Young. Young discloses a one-piece, prefabricated shaft or light well that includes four sidewalls extending upwardly from a flange. The light well also includes a support ledge formed around the sidewalls to hold the shaft in place as described below. To install the Young light well, an opening is formed in the both the roof and the ceiling of the structure. The opening in the ceiling must be formed directly below the opening in the roof to allow the flange to properly engage the ceiling. Next, the upper edge of the sidewalls is cut to match the height and pitch of the roof, and to either abut with the skylight or its box framing. This can be done by inserting the shaft up through the openings, until the flange engages the ceiling, and then marking the shaft as necessary for cutting. Once marked, the shaft can be removed and cut. Next, the shaft is reinserted into the openings, and a support frame is constructed around the shaft to engage the support ledge and maintain the light well in place. Finally, the curb and glass panel assembly are mounted to the roof.

While eliminating the need to box frame and sheetrock, the second technique still requires additional labor and materials to construct the support frame. It also requires that the shaft extend perpendicular to the ceiling rather than the roof. As a result, the size of the opening formed in ceiling is substantially smaller than could otherwise be obtained with a shaft extending perpendicular to the roof. Further, the one-piece light well is relatively bulky, thereby increasing the cost of shipping and packaging, and also making product handling and installation more difficult.

SUMMARY OF THE INVENTION

The aforementioned problems are overcome by the present invention wherein a skylight is provided with a modular shaft having interconnected panels that are secured directly to the skylight curb.

The present invention generally includes a glazing material, a curb, a shaft, and a trim ring. The glazing material mounts directly to the curb and typically includes an insulating glass assembly. The curb in turn mounts to the roof around a skylight opening and defines a downwardly opening channel with at least one serrated wall to receive the shaft. The shaft extends downwardly from the curb and includes modular panels that are interconnected by friction-fit corner connectors. A serrated hook is mounted to the upper edge of each panel. The hook fits within the channel to secure the panel directly to the curb. The lower end of each panel is trimmed even with the ceiling, and a variable size trim ring is attached to the ceiling to trim the skylight opening.

The present invention provides a skylight having a simple, yet fully functional, modular shaft that is easily installed and pleasing to the eye. The panels snap-fit directly to the curb, thereby eliminating the need for additional framing to support the skylight. Further, the panels are interconnected at the point of installation, thereby providing for ease of packaging and shipping. In addition, the shaft extends perpendicular to the roof, thereby increasing the size of the skylight opening formed in the ceiling when installed in a pitched roof.

These and other objects, advantages, and features of the present invention will be more fully understood and appreciated by reference to the detailed description of the preferred embodiment and the drawings.

DETAILED DESCRIPTION OF THE PREFERRED EMBODIMENT

Figure 1:
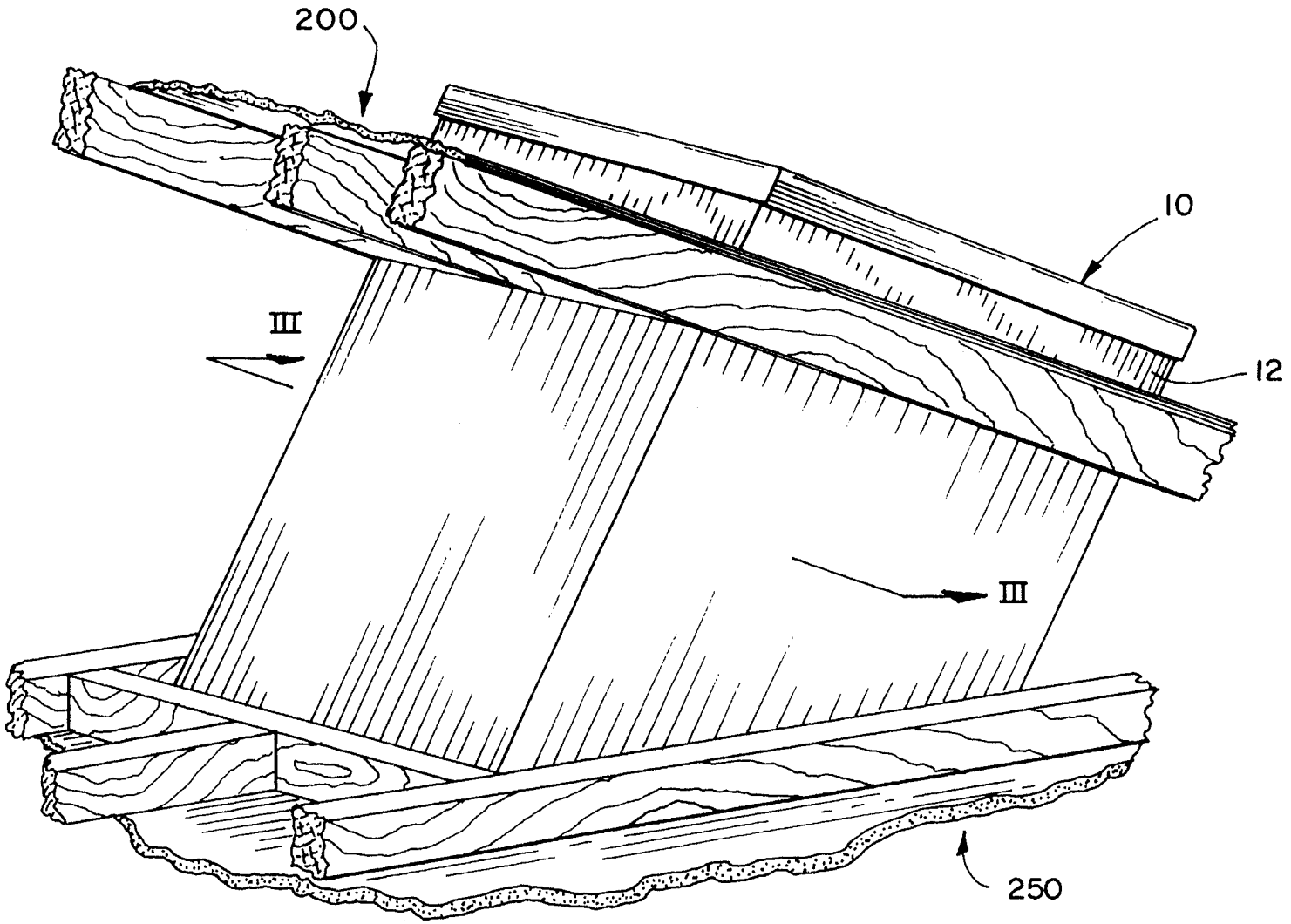
FIG. 1 is a perspective view of the present invention installed in a conventional building structure.

A skylight according to a preferred embodiment of the present invention is illustrated in FIG. 1 and generally designated 10. FIG. 1 shows the skylight 10 installed with a conventional pitched roof 200 and having a shaft 18 extending between an opening formed in the roof and an opening formed in the ceiling 250 below. While the skylight is described in connection with a flat ceiling, it should be readily apparent that it is equally well suited for installation in a cathedral ceiling. For purposes of this disclosure, directional terms, such as "upwardly" "downwardly" "top", "bottom", "upper", and "lower" will be used to denote directions relative to the normal orientation of an installed skylight In addition, the terms "inwardly" "outwardly" "inner" and "outer" will be used to denote the directions toward and away from the center of the opening defined by the skylight curb 12.

Figure 2:
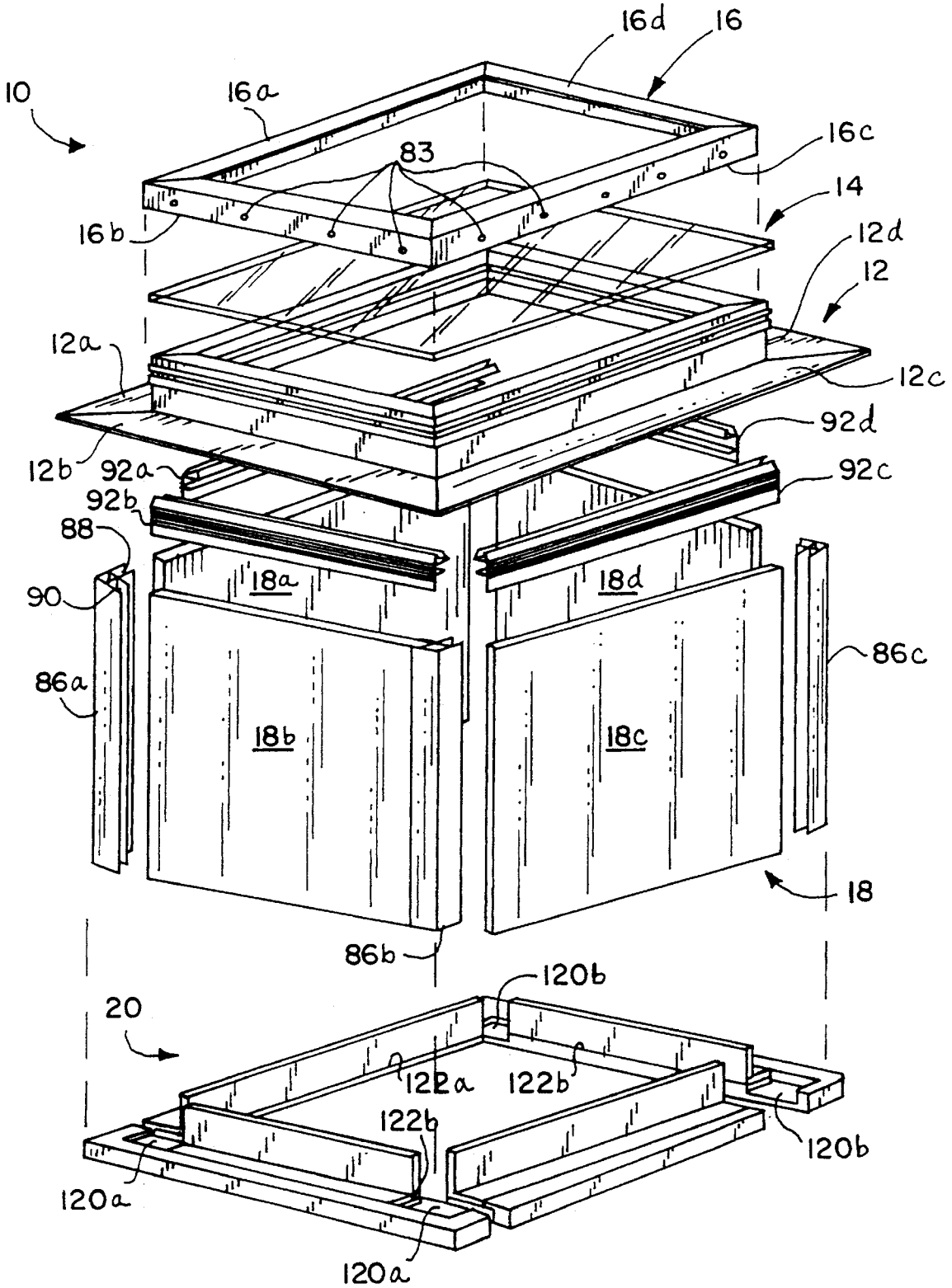
FIG. 2 is an exploded perspective view of the skylight.

As perhaps best illustrated in FIG. 2, the present invention generally includes a curb 12, an insulating glass panel assembly 14, a retainer 16, a modular shaft 18, and a trim ring 20. The curb 12 is a peripheral frame manufactured by mitre cutting and welding individual curb members from an extruded, elongated polymeric profile. In the preferred embodiment, the curb 10 is substantially rectangular and includes four curb members 12*a–d* dimensioned to provide an assembled frame that fits around the desired skylight opening.

Figure 3:
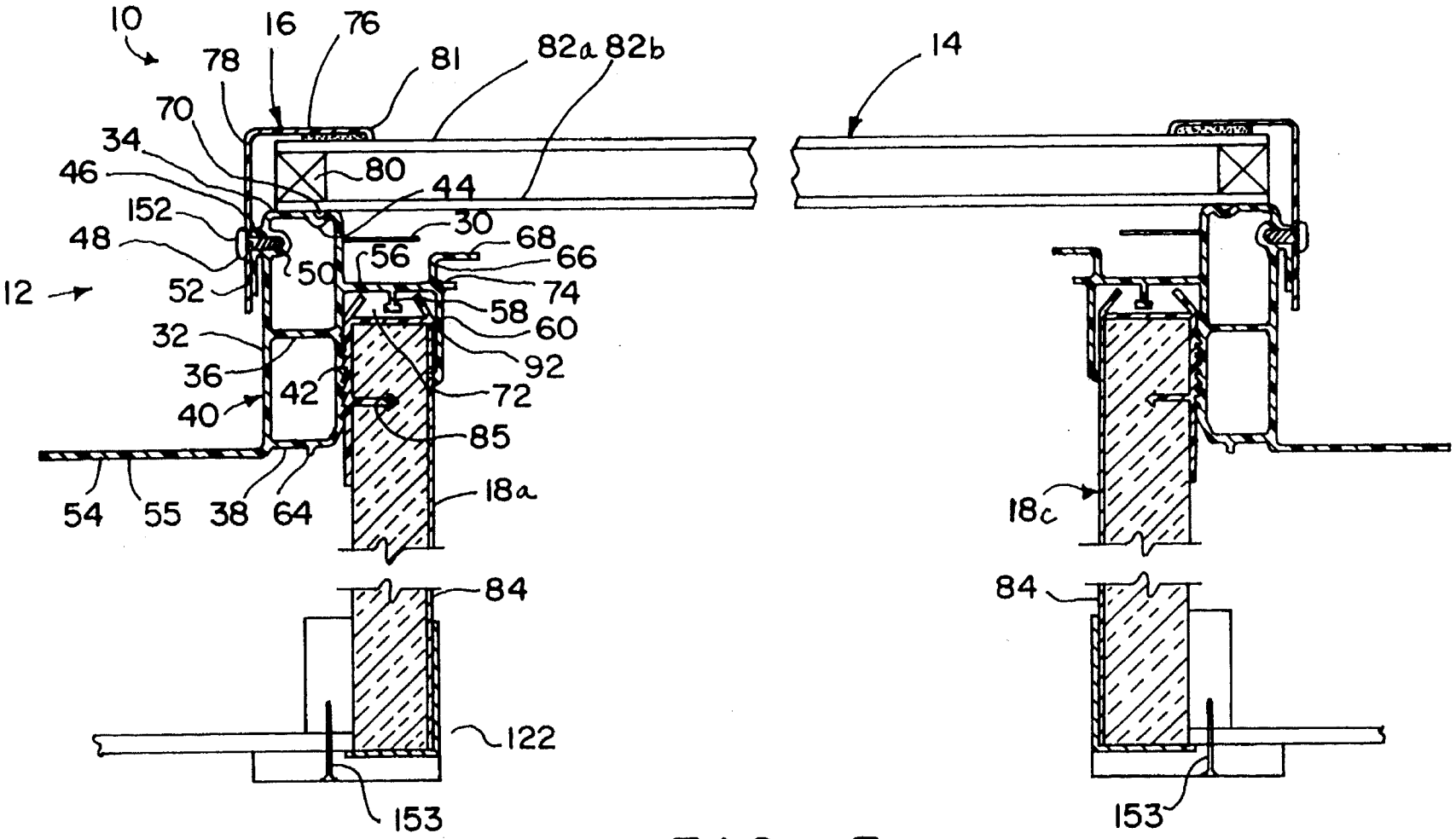
FIG. 3 is a sectional view of the skylight along line III—III of FIG. 1.

Referring now to FIG. 3, the curb 12 generally includes spaced apart and substantially parallel inner and outer walls 30 and 32 that, when installed, extend upwardly from the plane defined by the roof. Top 34, center 36, and bottom 38 walls extend perpendicularly between, and cooperate with, the inner and outer walls 30 and 32 to form a generally rectangular structural member 40 extending the length of each curb member 12*a–d*. A portion of the inner surface of the inner wall 30 is serrated by a plurality of longitudinal, closely spaced grooves 42. A first longitudinal recess 44 is formed in the top wall 34 to seat a gasket 70 as described below. A second longitudinal recess 50 is formed in the outer wall 32. A pair of parallel, spaced apart ribs 46 and 48 extend outwardly along opposite longitudinal edges of recess 50. The facing surfaces of ribs 46 and 48 are grooved to form a screw boss extending the length of each curb member. A retainer support lip 52 extends downwardly from the outer edge of rib 48. A longitudinal spacing rib 64 extends downwardly from a central portion of the bottom wall 38 to ensure proper alignment of the curb 12 with the roof 200.

The curb 12 also includes an outer flange 54 extending perpendicularly outward from the lower edge of the outer wall 32, and an inner flange 56 extending perpendicularly inward from a central portion of the inner wall 30. A series of mounting holes 55 are formed through the outer flange 54 to allow the curb 12 to mount to the roof 200 by conventional fasteners, such as screws or roofing nails. A second longitudinal spacing rib 58 extends downwardly from a central portion of the inner flange 56 to facilitate proper spacing of the shaft 18 with respect to the curb 12. A lower flange 60 extends downwardly from an inner portion of the inner flange 56. A ridge 62 is formed longitudinally along the outer, lower edge of the lower flange 60 to engage the installed shaft 18. Together, the inner wall 30, inner flange 56, and lower flange 60 cooperate to define a channel 72 for receiving the shaft 18 as described below.

In a preferred embodiment, the curb 12 further includes an upper flange 66 extending upwardly from a central portion of the inner flange 56 and a screen support lip 68 extending inwardly along the upper edge of the upper flange 56. Together, the inner flange 56, upper flange 66, and screen support lip 68 cooperate to define a channel 74 for receiving a screen assembly.

As noted above, the skylight 10 further includes a glass panel assembly 14. The glass panel assembly 14 is preferably a conventional insulating glass having a spacer frame 80 sandwiched between a pair of spaced apart ⅛ inch high strength, glass panels 82*a–b*. The panel assembly 14 is dimensioned to fit upon the top wall 34 of the curb 12 where it is secured by the retainer 16 as described below. Alternatively, the glass panel assembly 14 can be replaced by a variety of other glazing materials, such plastic or other transparent or translucent materials.

As perhaps best illustrated in FIG. 3, the glass panel assembly 14 is secured to the curb 12 by retainer 16. In a preferred embodiment, retainer 16 is manufactured from an extruded, elongated, L-shaped profile of aluminum having top and side walls 76 and 78. Individual retainer members 16*a–d* are mitre cut and welded to form a peripheral frame. The top wall 76 of the retainer extends inwardly and includes a downwardly extending ridge 81 along its inner edge to engage the glass panel assembly 14. A plurality of mounting holes 83 (See FIG. 2) are formed through the side wall 78 of the retainer 16 in alignment with recess 50.

The shaft 18 generally includes four rectangular, expanded polystyrene panels 18*a–d* each having a 0.040 inch vinyl skin 84 laminated to a single major surface (See FIGS. 2 and 3). The width of each of the panels 18*a–d* is selected to match the width of a corresponding curb member 12*a–d*, and the height of each panel 18*a–d* is selected to exceed the typical span between the roof and ceiling openings. A longitudinal groove 85 is formed in an upper portion of the outer surface of each panel 18*a–d* to facilitate mounting as described below. While expanded polystyrene provides the desired insulating and structural properties, the panels can be manufactured from a variety of other rigid, light-weight materials, such as pressboard, fiberboard, and fiberglass.

The panels 18*a–d* are interconnected by a number of corner connectors 86. As perhaps best illustrated in FIG. 2, each corner connectors 86 is an elongated, extruded polymeric profile defining a pair of longitudinal channels 88 and 90 opening in directions normal to one another. Adjacent panels are friction-fit into the channels 88 and 90 of the appropriate corner connectors 86 to intersecure the panels in a rectangular configuration.

Figure 4:
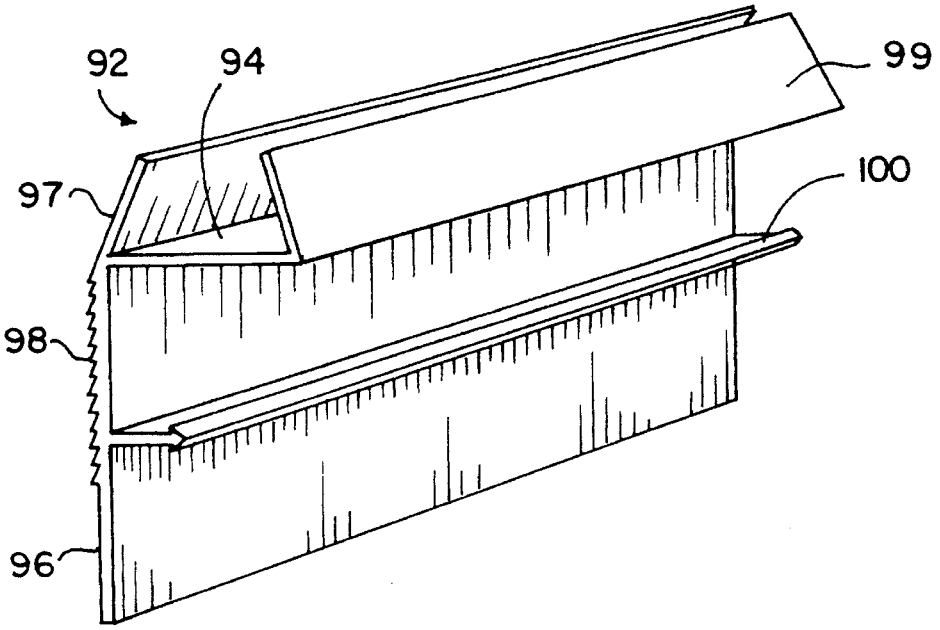
FIG. 4 is a perspective view of the hook.

A hook 92*a–d* is mounted to the upper edge of each panel 18*a–d* to allow the panel to snap-fit into channel 72 formed in the curb 12. As perhaps best illustrated in FIG. 4, the hook 92*a–d* is an elongated, extruded, generally L-shaped polymeric profile having top and side walls 94 and 96. A portion of the outer surface of side wall 96 is serrated by a plurality of longitudinal, closely spaced grooves 98 adapted to engage grooves 42. A barbed spine 100 extends inwardly from a central portion of the inner face of side wall 96 to engage groove 85, thereby securing the hook 92*a–d* to the upper edge of the appropriate panel 18*a–d*. A pair of angled flanges 97 and 99 extend upwardly toward each other from opposite longitudinal edges of the top wall 94. These flanges 97 and 99 help to guide the hook 92*a–d* into the channel 72 and to ensure appropriate spacing.

Figure 5:
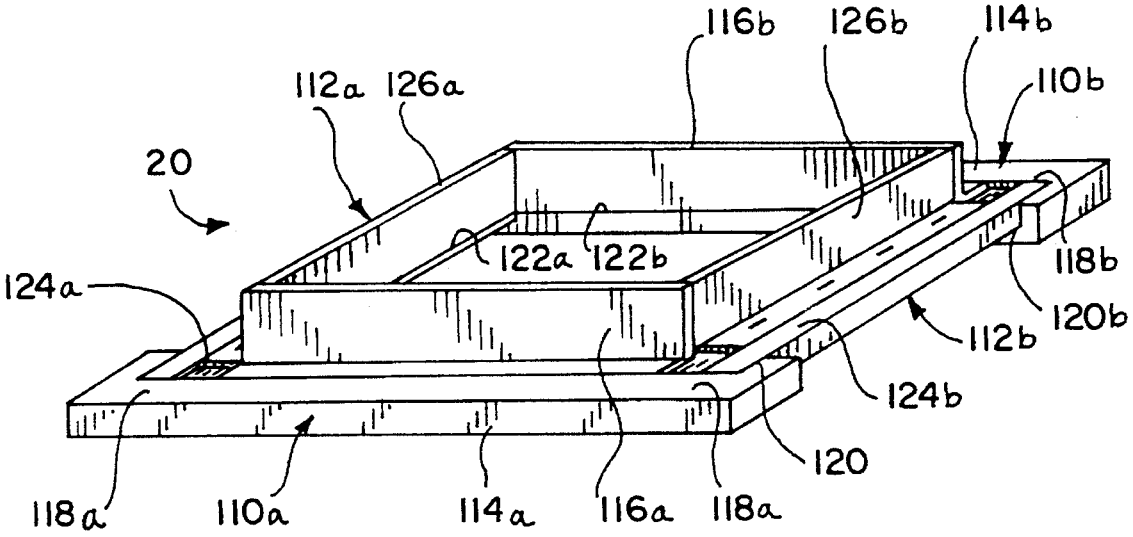
FIG. 5 is a perspective view of the trim ring.

As noted above, the skylight 10 also includes a variable size trim ring 20 that functions to trim the juncture of the shaft 18 and ceiling 250. In a preferred embodiment, the trim ring 20 is a peripheral frame manufactured from two L-shaped end members 110*a–b* extending between two L-shaped side members 112*a–b* (See FIG. 5). The end members 110*a–b* each include a bottom wall 114*a–b* and a sidewall 116*a–b*. The bottom wall 114*a–b* is preferably manufactured from wood and includes marginal portions 118*a–b* that extend beyond opposite longitudinal ends of sidewall 116*a–b*. Notches 120*a–b* are formed in the marginal portions 118*a–b* of each bottom wall 114*a–b* to receive the bottom wall 124*a–b* of the side members 112*a–b*. The sidewalls 112*a–b* of the end members are preferably manufactured from plastic and have an L-shaped profile dimensioned to fit within the ends of the skylight opening formed in the ceiling 250 and to attach to the bottom wall 114*a–b* as described below. Preferably, the side members 112*a–b* each include a wood bottom wall 124*a–b* and a plastic sidewall 126*a–b*. The bottom walls 124*a–b* are dimensioned to extend between the end members 110*a–b* and to fit within notches 120*a–b* to provide a flush upper surface for engagement with the ceiling 250. The sidewalls 126*a–b* are similar in profile to sidewalls 112*a–b* and are dimensioned to extend between the end members 110*a–b* within the skylight opening formed in the ceiling. The bottom walls of both the side and end members each include a narrow longitudinal recess 122*a–b* adapted to receive the appropriate sidewalls. The bottom and sidewalls are preferably interconnected by stapling the corresponding sidewall into recess 122*a–b*. While the trim ring 20 is preferably manufactured from wood and plastic, a variety of other materials will suffice.

ASSEMBLY AND INSTALLATION

The present invention can be installed in commercial or residential structures. First, a skylight opening matching the dimensions of the skylight 10 is cut through both the roof 200 and ceiling 250. Typically, the openings extend between a pair of joists and are box framed with headers to provide the necessary structural support. Any shingles, shakes, or roof coverings immediately surrounding the opening are removed to allow the outer flange of the curb 12 to lie directly upon the roof 200. The curb 12 is then mounted to roof 200 around the skylight opening by driving screws or roofing nails into the roofing through mounting holes 55. Once the curb 12 is installed, a gasket 70 is applied around the top wall 34 in recess 44. The gasket is preferably a foamable gasket such as Readiseal sold by ODL, Inc. of Zeeland, Mich. However, a conventional rubber gasket may be substituted.

The glass panel assembly 14 is placed upon the top wall 34 of the curb 12 and secured by retainer 16. Typically, the glass panel assembly 14 is purchased preassembled from any of a variety of well known suppliers. As shown in FIG. 3, a silicone sealant 150 is applied between the retainer 16 and the glass panel assembly 14 to provide a weather-tight seal. The retainer 16 is secured directly to the curb 12 by a plurality of screws 152 extending through mounting holes 82 into recess 50.

Subsequently, each of the panels 18*a–d* are inserted up through the skylight opening in the ceiling into channel 72. The panels 18*a–d* are inserted with the vinyl skin 84 facing inwardly. The panels are marked along the edge of the ceiling, removed from the opening, and cut. If necessary, the corners connectors 86*a–d* are cut to match the height of the panels 18*a–d*. Next, the shaft 18 is assembled by interconnecting adjacent panels 18*a–d* with the corner connectors 86*a–d*. The hooks 92*a–d* are mounted to the top of the corresponding panels 18*a–d*, and the entire shaft 18 is reinserted through the skylight opening so that the hooks 92*a–d* snap-fit into channel 72. The serrated surfaces of the hooks 92*a–d* engage the serrated surfaces of channel 72 to resist removal of the shaft 18 from the curb 12.

The trim ring 20 is assembled by cutting the side members 112*a–b* to match the length of the skylight opening formed in the ceiling. This length may or may not match the length of the skylight opening formed in the roof depending on the pitch of the ceiling and roof. For example, when a 3 foot long skylight is installed in a roof having a 12/4 pitch, the length of the ceiling opening will be approximately 3 feet 2 inches. Once the side members 112*a–b* are cut, they are inserted into the opening as shown in FIG. 3 and secured to the ceiling by conventional fasteners, such as screws 153. Next, the end members 114*a–b* are inserted into the skylight opening such that notches 120*a–b* fit over the longitudinal ends of the side members 112*a–b*. The end members 114*a–b* are secured to the ceiling 250 by conventional fasteners, such as screws.

The present invention has been described in connection with a fixed skylight. However, the present invention is equally well suited for use with a ventilating skylight. When used in connection with a ventilating skylight, a conventional screen assembly (not shown) can be installed in channel 74 to exclude pests and debris.

In addition, the present invention has been described with a rectangular configuration. One of ordinary skill in the art will immediately recognize that the present invention can be adapted to provide nearly any desired configuration-including but not limited to pentagonal, heptagonal, or octagonal configurations.

The above description is that of a preferred embodiment of the invention. Various alterations and changes can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A skylight, comprising:

a roof curb adapted to mount about an opening formed in a roof, said curb including a flange adapted to engage the roof and said curb defining a channel;

a glazing material;

first securing means for securing said glazing material to said curb;

a ceiling frame adapted to mount about an opening formed in a ceiling;

a modular shaft extending between said curb and said frame; said shaft including a plurality of interconnected independent rigid panels each defining a sidewall of said shaft; and said shaft further including a second securing means for securing said shaft to said curb through a slide fit into said channel and third securing means for securing said shaft directly to said ceiling frame.

2. The skylight of claim 1, wherein said second securing means includes first and second fastening elements mounted to said shaft and said curb, respectively, said fastening elements adapted to mount directly to one another whereby said shaft mounts directly to said curb.

3. The skylight of claim 1, wherein said second securing means includes a hook mounted to said shaft and a channel defined by said curb, said hook being securably received within said channel.

4. The skylight of claim 3, wherein said hook and said channel each include a serrated portion, said serrated portions engaging one another to resist removal of said hook from said channel.

5. The skylight of claim 1, wherein said modular shaft further comprises connector means for directly intersecuring said panels.

6. The skylight of claim 5, wherein said frame comprises a variable size trim ring adapted to mount about the ceiling opening.

7. A skylight and light shaft assembly installed in and between a roof opening formed through a roof and a ceiling opening formed through a ceiling, said assembly comprising:

a curb mounted to the roof around the roof opening, said curb including a flange adapted to engage the roof and said curb defining a channel;

a modular light shaft extending between said curb and the ceiling opening, said light shaft including a plurality of independent rigid panels each extending between said curb and the ceiling opening, said light shaft further including connector means for directly intersecuring said independent panels and said shaft further including a second securing means for securing means for securing said shaft to said curb through a slide fit into said channels.

8. The assembly of claim 7, wherein said securing means includes first and second fastening elements mounted to at least one of said panels and said curb, respectively, said fastening elements adapted to mount directly to one another whereby at least one of said panels is mounted directly to said curb.

9. The assembly of claim 7, wherein said securing means includes a hook mounted to at least one of said panels and a channel defined by said curb, said hook being securably received within said channel.

10. The assembly of claim 9, wherein a portion of said hook and a portion of said channel include a plurality of closely spaced, longitudinal grooves, said portions engaging one another to resist removal of said hook from said channel.

11. The assembly of claim 10, further comprising a variable size trim ring adapted to mount around the second opening.

12. In a skylight including a curb mounted around an opening formed in a roof and a shaft extending between the opening in the roof and an opening formed in a ceiling, wherein the improvement comprises:

said curb defining a channel; said shaft comprising a plurality of independent, rigid panels, each extending between the roof opening and the ceiling opening and each having a pair of opposed vertical edges and said shaft including a first securing means for securing said shaft to said curb through a slide fit into said channel; and second securing means for directly intersecuring the vertical edges of adjacent panels to one another.

13. The improved skylight of claim 12, wherein said securing means includes a channel defined by said curb and a hook mounted to said shaft, said hook being securably received within said channel, whereby said shaft is mounted directly to said curb.

14. The improved skylight of claim 13, wherein said hook and said channel each include a serrated portion, said serrated portions engaging one another to resist removal of said hook from said channel.

15. The improved skylight of claim 14, further comprising a variable size trim ring adapted to mount about the opening formed in the ceiling.

* * * * *

UNITED STATES PATENT AND TRADEMARK OFFICE

CERTIFICATE OF CORRECTION

PATENT NO. : 5,544,455
DATED : August 13, 1996
INVENTOR(S) : David A. DeBlock

It is certified that error appears in the above-indentified patent and that said Letters Patent is hereby corrected as shown below:

Column 6, Claim 1, Line 19:
after "shaft" delete --;--

Column 6, Claim 1, Line 21:
after "channel" insert --;--

Column 6, Claim 7, Line 57:
after second occurrence of "securing" delete --means for securing--

Signed and Sealed this

Twelfth Day of November, 1996

*Attest:*

Bruce Lehman

BRUCE LEHMAN

*Attesting Officer*

*Commissioner of Patents and Trademarks*